US006622516B1

(12) United States Patent
Horen

(10) Patent No.: US 6,622,516 B1
(45) Date of Patent: Sep. 23, 2003

(54) ICE MOLD AND METHOD FOR COOLING DRINK BOTTLES

(76) Inventor: Don Horen, 7800 Roaring Ridge Dr., Plano, TX (US) 75025

( * ) Notice: Subject to any disclaimer, the term of this patent is extended or adjusted under 35 U.S.C. 154(b) by 0 days.

(21) Appl. No.: 10/195,245

(22) Filed: Jul. 15, 2002

(51) Int. Cl.[7] ..... F25D 3/08
(52) U.S. Cl. ..... 62/457.4; 62/457.7
(58) Field of Search ..... 62/457.1, 457.2, 62/457.3, 457.4, 457.7, 457.8, 371, 372

(56) References Cited

U.S. PATENT DOCUMENTS 3,840,153 A * 10/1974 Devlin ..... 222/146.6
5,009,083 A * 4/1991 Spinos et al. ..... 62/400
5,129,238 A * 7/1992 Schwartz et al. ..... 62/457.3
5,148,682 A 9/1992 Wolf ..... 62/59
5,177,981 A 1/1993 Haas ..... 62/457.3
5,406,808 A * 4/1995 Babb et al. ..... 62/457.4
5,456,090 A * 10/1995 McCoy ..... 62/372
5,467,877 A * 11/1995 Smith ..... 215/11.1
5,472,274 A * 12/1995 Baillie ..... 366/129
5,507,156 A * 4/1996 Redmon ..... 12/114.2
5,590,542 A * 1/1997 Wang ..... 62/457.3
5,609,039 A * 3/1997 Green et al. ..... 62/457.3
6,276,163 B1 * 8/2001 Broadbent ..... 62/457.4
6,494,056 B1 * 12/2002 Roth et al. ..... 62/457.3

* cited by examiner

*Primary Examiner*—William E. Tapolcai
*Assistant Examiner*—Mohammad M. Ali
(74) *Attorney, Agent, or Firm*—Conley Rose, P.C.

(57) ABSTRACT

A mold for forming an ice ring on the inner surface of a bottle. The mold is in the form of a cylinder. One end of the mold carries a seal sized to form a fluid tight seal with the inner surface of the bottle neck. The mold is preferably hollow and has a handle attached to the end near the seal. The mold is inserted through the bottle neck until the seal forms a fluid tight seal with the bottle neck. Water is then poured into the bottle through the handle. The bottle is inverted and excess water allowed to flow out through the mold. The bottle is then set on the handle in a freezer until the water freezes. The mold is then removed. The bottle may then be filled with a selected drink through the ice ring.

5 Claims, 3 Drawing Sheets

ICE MOLD AND METHOD FOR COOLING DRINK BOTTLES

BACKGROUND OF THE INVENTION

The present invention relates to apparatus and methods for cooling drinks in a bottle and more particularly to an ice mold for forming an ice ring on the inner surface of a drink bottle and a method for forming such an ice ring.

It has become common for people to carry a personal drink bottle of water, ice tea, sports drink or other soft drink with them at essentially all times. Generally, the bottles are plastic and have a screw top. By replacing the top on a partially used bottle, it may be carried, e.g. in a pocket, purse, backpack, etc., without spilling. Many of the bottles have a valve built into the screw top and are referred to as sports bottles because the valve top allows the user to open and close the bottle without removing the top, thereby facilitating the ability of the user to drink from the bottle while walking, running, etc. without spilling the drink.

It is also common for people to cool their drinks with ice. The ice is normally in the form of ice cubes placed into a glass or mug along with a selected drink. It is essentially impossible to place ice cubes in personal drink bottles since ice cubes will not fit through the neck of the bottle. As a result, the drink bottle must be placed in a refrigerator, ice bucket, or other cooling device for sufficient time to cool the drink in advance of the time it is needed. Such pre-chilling does not provide the same continued chilling effect as having actual ice mixed with the drink.

While personal drink bottles are generally considered to be disposable, many people reuse the bottles by refilling them with tap water or with their favorite drink from a larger container. The reuse of such bottles is popular because it is an effective way for people to simultaneously economize and preserve natural resources. It would be desirable, therefore, to provide a system for cooling drinks in personal drink bottles, especially in conjunction with the reuse of personal drink bottles.

Other drink bottles are intended for reuse. In contrast to disposable drink bottles, reusable drink bottles are typically designed to withstand repeated uses. Accordingly, reusable drink bottles are often constructed of more durable and/or flexible materials. Oftentimes, reusable drink bottles are also better suited to resist permanent deformation. For example, some reusable drink bottles are designed for carrying in a holding fixture mounted on the frame of a bicycle. Despite their superiority over disposable bottles, These bottles also share the problem of having a relatively small neck which prevents the insertion of ice cubes.

SUMMARY OF THE INVENTION

The present invention provides a mold system for forming an ice ring on the inner surface of a drink bottle. The system includes a cylindrical shaft sized to fit through a bottle neck and to extend part way into the bottle interior. On one end of the shaft is a seal member which forms a water tight seal between the mold and the neck of the bottle.

The method of the present invention includes placing a selected amount of a drink in a bottle and inserting the shaft through the neck of the bottle until the seal member forms a water tight seal with the neck. The bottle is then inverted by placing the neck side down in a freezer until the drink is frozen. The mold is then removed, leaving a ring of ice on the upper inner surface of the drink bottle. The bottle is then returned to the upright position and refilled through the ice ring with a selected drink. The ice ring will then act to chill the selected drink in various fashions. For example, if a sufficient amount of the selected drink is added to the bottle, the ice ring will be submerged in the selected drink. The selected drink may be further chilled as it flows through the ice ring whenever the user drinks from the bottle. The ice ring may also detach itself from the upper inner surface of the drink bottle and begin floating in the selected drink. For certain bottle geometries, detachment of the ice ring may occur almost immediately after the bottle is returned to the upright position. For others, a period of time which allows a portion of the ice ring to melt must elapse before the ice ring will detach from the upper inner surface of the drink bottle.

In one embodiment the mold has a fluid passageway from one end to the other. In this embodiment, the mold may be inserted into the drink bottle and water may be poured through the mold into the drink bottle. In this embodiment, the mold may act as a measuring device. When the drink bottle is inverted for freezing, any excess water is released through the mold.

In another embodiment, the shaft has a handle on one end, opposite the end to be inserted into the drink bottle. The handle preferably has a generally flat surface perpendicular to the central axis of the mold. The handle aids in insertion of the mold into the drink bottle and removal therefrom. The flat surface also acts as a supporting stand for positioning the drink bottle in an inverted position while the water is frozen. In the embodiment with a fluid passageway, the passageway extends through the handle.

DETAILED DESCRIPTION

Figure 1:
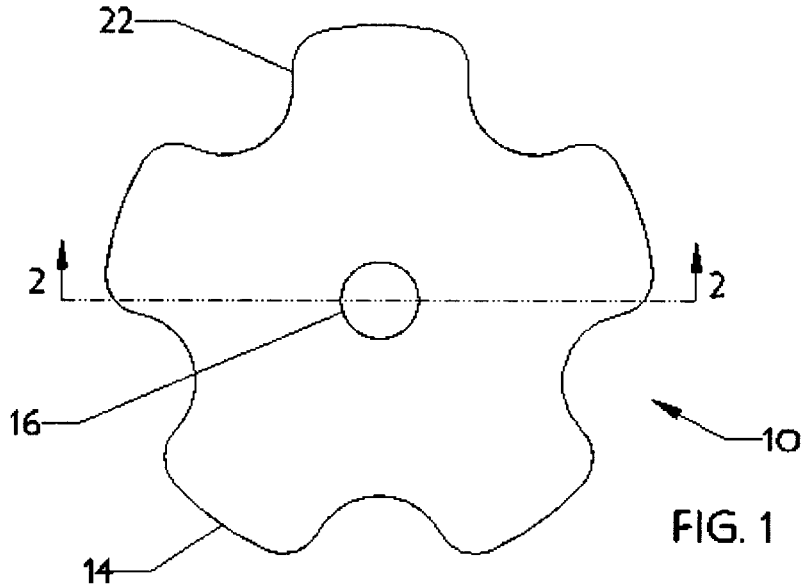
FIG. 1 is a top view of an ice mold constructed in accordance with the teachings of the present invention.
Figure 2:
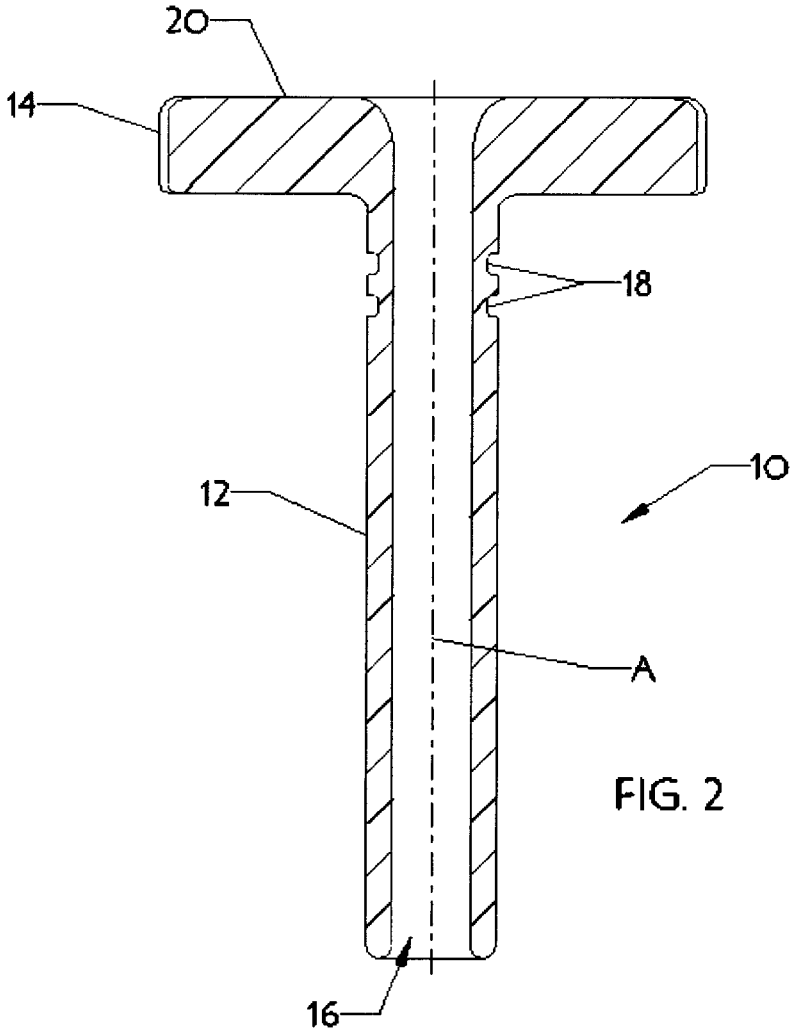
FIG. 2 is a cross-sectional side view of the ice mold of FIG. 1 taken along lines 2—2 thereof.

With reference now to FIGS. 1 and 2, an ice mold 10 according to one embodiment of the present invention will be described. The ice mold 10 comprises primarily a cylindrical shaft 12 with a handle 14 attached to one end. The shaft 12 may be solid, but is preferably formed as a hollow cylinder having an open central passageway 16 which extends through the shaft 12 and the handle 14. The mold 10 is preferably cast from a hardened plastic material which provides a smooth surface. A single annular recess or groove 18 sized to receive an O-ring is preferably provided on the cylindrical shaft 12 near the handle 14. As will be more fully described below, when an O-ring is installed in the groove 18 on shaft 12, it provides one means by which a water tight seal with a drink bottle neck is achieved. Of course, a wide variety of other techniques may be used to provide a water tight seal between the shaft 12 and the drink bottle neck. For example, in place of the groove 18, a peripheral flange member or other type of circumferential protuberance may be formed on the shaft 12. In this aspect, the flange member or other type of circumferential protuberance may be formed of the same material as the shaft 12 or, preferably, is formed of a material with a higher degree of compressibility than the shaft 12.

The handle 14 preferably has a flat surface 20 on one side opposite the cylindrical shaft 12. The surface 20 is preferably at a generally orthogonal angle to longitudinal axis A of the cylindrical shaft 12. The handle 14 has a knurled or contoured circumference 22 for facilitating manual gripping. Preferably, the handle 14 is integrally formed as a single piece with the cylindrical shaft 12, for example, using a die cast process.

Figure 3:
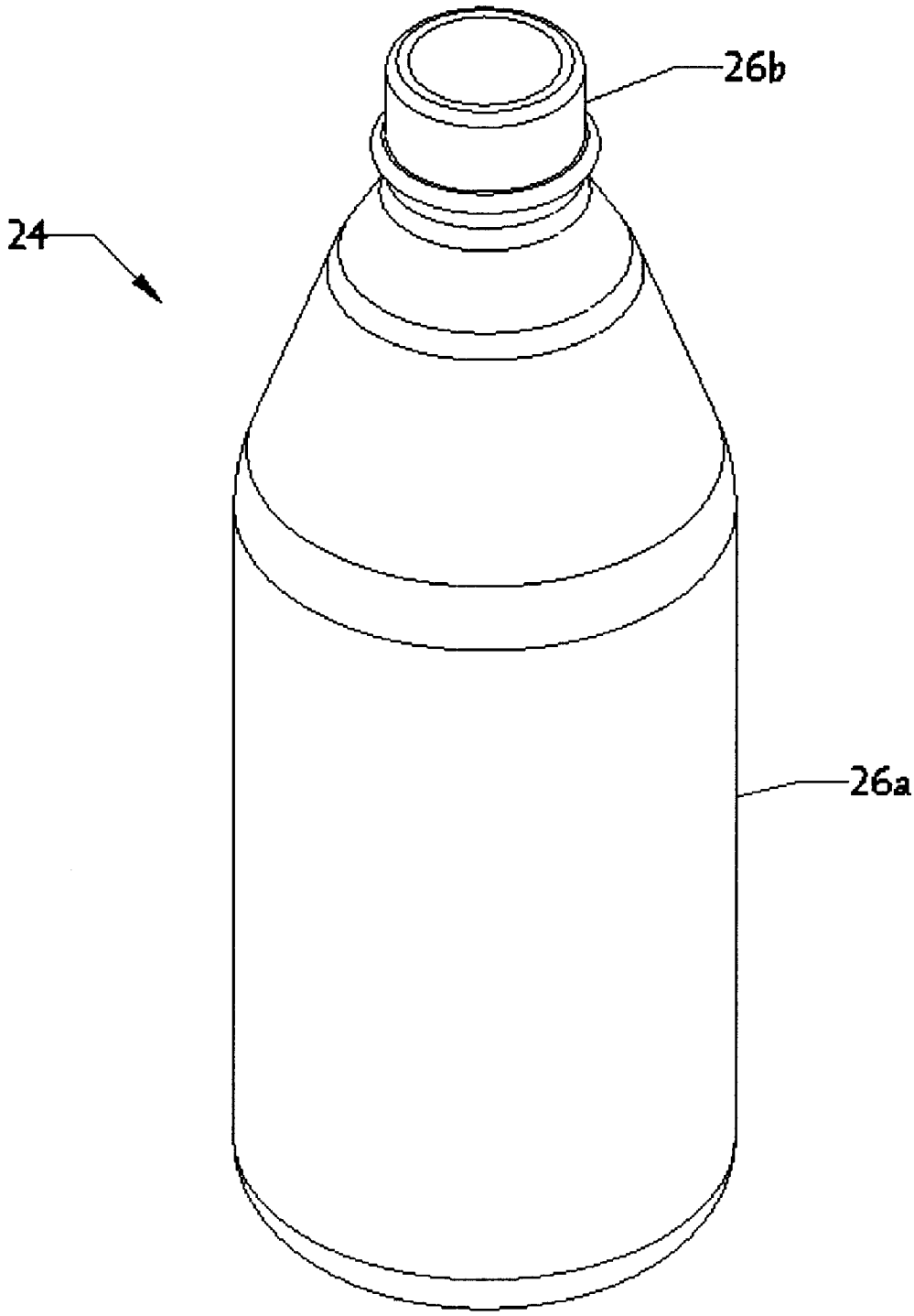
FIG. 3 is a perspective view of a typical drink bottle suitable for use with the ice mold of FIGS. 1–2.

FIG. 3 is a perspective view of a typical drink bottle 24 suitable for use with an ice mold according to the present invention. The bottle 24 may be any typical plastic bottle in which water, sports drinks, carbonated soft drinks, etc. are sold. Such bottles have a main body portion 26*a* which defines an interior volume for the bottle and a neck portion 26*b* integrally formed with the main body portion 26*a*. The neck portion 26*b* is normally threaded on its outer surface for receiving a screw-on cap (not shown), oftentimes equipped with a closeable valve (also not shown). The inner surface of the neck portion 26*b* is normally a smooth cylindrical surface. While many such bottles are considered disposable, many people refill the bottles since they can be resealed with the original cap and are usually durable enough to be used several times.

Figure 4:
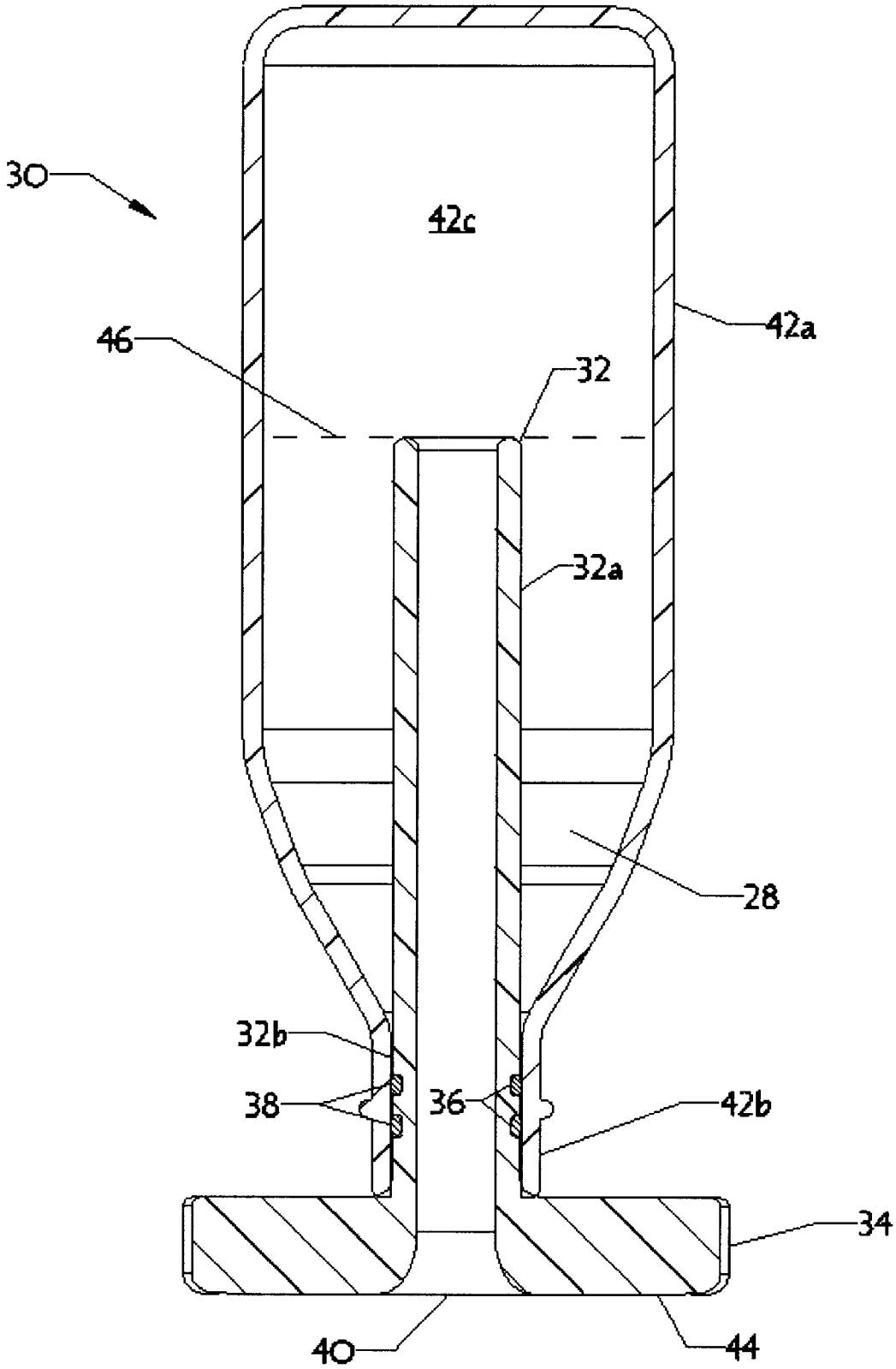
FIG. 4 is a cross-sectional view of the ice mold of FIGS. 1–2 after insertion into the drink bottle of FIG. 3.

FIG. 4 is an illustration of an ice mold 28 according to the present invention inserted into a typical drink bottle 30. The ice mold 28 is a slightly different embodiment than ice mold 10 of FIGS. 1 and 2. It includes a hollow cylindrical shaft 32 having a handle 34 attached, e.g. by molding as one piece, to one end of the shaft 32. The ice mold 28 has two grooves 36 on its outer surface near handle 34 carrying two o-rings 38. The primary difference between molds 10 and 28 is the number of O-rings used to form a seal. The mold 28 has an open central passageway 40 through the shaft 32 and handle 34.

The use of the ice mold 10 or 28 of the present invention will be described primarily with reference to FIG. 4. In FIG. 4, the bottle 30 is illustrated upside down, i.e. with the main body portion 42*a* (which defines inner volume 42*c*) and neck portion 42*b* down, instead of up. The ice mold 28 is inserted into the neck portion 42*b* so that essentially the entire cylindrical shaft portion 32 is inside the bottle 30. Preferably, the ice mold 28 is inserted such that a first portion 32*a* of the cylindrical shaft portion 32 is inside the interior volume 42*c* defined by the main body portion 42*a* of the bottle 30 and a second portion 32*b* of the cylindrical shaft portion 32 is inside the neck portion 42*a* of the bottle 30. The O-rings 38 contact and form a fluid tight seal between the second portion 32*b* of the cylindrical shaft portion 32 of the ice mold 28 and the inner surface of the neck portion 42*b* of bottle 30. Of course, it is fully contemplated that the use of one or more O-rings is but one suitable technique for achieving a fluid tight seal and that various other sealing techniques are suitable for the purposes contemplated herein. Once sealed, the combined assembly of the ice mold 28 and bottle 24 may be set on the "top" flat surface 44 of the handle portion 34 as shown in FIG. 4.

The ice mold 28 is inserted into the bottle 30 with the bottle in the normal upright position, i.e. with the neck portion 42*b* up. A quantity of water or other drink is then poured through the central passageway 40 in the ice mold 28 and into the bottle 30. The assembly of the ice mold 28, the bottle 30 and liquid is then inverted into the position shown in FIG. 4. If too much fluid was put in the bottle 30, the excess will drain out through the opening 40 until the fluid level is at the dashed line 46 even with the end of the first portion 32*a* of the cylindrical shaft 32. The assembly is then placed in a freezer space standing on the handle 34 until the liquid freezes. Then the ice mold 28 may be removed by gripping the handle 34 and simultaneously twisting and pulling the ice mold 28 from the bottle 30. This leaves an ice ring in the upper portion of bottle 24, that is, the ice ring is between the dashed line 46, the inner side surface of the main body portion 42*a* of the bottle 30, the neck portion 42*b* (or, more specifically, the former location of the fluid tight seal between the neck portion 42*b* and the second portion 32*b* of the cylindrical shaft 32) and the former location of the exterior side surface of the first portion 32*a* of the cylindrical shaft 32. Of course, if a lesser amount of fluid was put in the bottle 30, the fluid level would be lower than the dashed line 46 and the ice ring formed in the upper portion of the bottle 30 would be smaller than that illustrated in FIG. 4.

A standard cap, either equipped with or without a closeable valve, may then be placed on the bottle 30 and the bottle 30 with ice ring may be stored in the freezer space until it is needed. When the user needs a bottle of cooled drink, the cap may be removed and a drink, e.g. water, is poured through the ice ring and into the bottle 30. The drink will be cooled by contact with the ice ring in the bottle 30 as it is poured into the bottle 30. Furthermore, if a sufficient amount of the drink is added to the bottle 30, the ice ring will be submerged in the drink, thereby enhancing the cooling effect. Finally, the drink will also be cooled during drinking since it must flow through the middle of the ice ring to flow out of the neck 42 of the bottle 30. Once formed, the ice ring may also detach itself form the inner surface of the bottle 30 and begin floating in the selected drink. For certain bottle geometries, detachment of the ice ring may occur almost immediately after the bottle 30 is returned to the upright position. For others, a period of time which allows a portion of the ice ring to melt must elapse before the ice ring will detach from the inner surface of the bottle 30.

In an alternate aspect of the invention, rather than removing the ice mold 28 from the bottle 30 after an ice ring has been formed from the water or other drink poured into the bottle 30, the ice mold 28 may be left in the bottle 30 and the ice mold 28/bottle 30 assembly, now with an ice ring formed in the bottle 30, may be stored in the freezer space until needed. In this aspect, when the user needs a bottle of a cooled drink, a desired amount of the drink is poured through the central passageway 40 in the ice mold 28 and into the bottle 30. While pouring the drink into the bottle 30, the drink will be cooled by contact with the ice ring and/or the ice mold 28. As the drink is cooled by the ice ring and/or the ice mold 28, the ice mold 28 will be warmed by the drink. As the ice mold 28 is warmed, the ice ring formed thereon will loosen, thereby facilitating the subsequent removal of the ice mold 28, again by having the user grip the handle 34 and simultaneously twist and pull the ice mold 28 from the bottle 30. As before, once the ice mold 28 has been removed, a standard cap, either equipped with or without a closeable valve, may then be placed on the bottle 30 and the bottle 30 with ice ring and drink is ready for use. Of course, while the bottle 30 with ice ring and drink may instead be returned to storage, care should be used since, if returned to the freezer space, the drink may freeze if stored for too long. Conversely, if the bottle 30 with ice ring and drink is placed in a refrigerator, the ice ring may melt if stored for too long.

While the use has been described with the use of water to form an ice ring in the bottle 30, other liquid drinks may also be used. For example a sports drink may be poured into the bottle 30 and frozen into an ice ring. This is especially useful when the fluid which the user desires to cool is the same sports drink. This avoids dilution of the sports drink with water from the melting ice ring. The term "ice" as used herein means any frozen liquid which comprises a suitable drink for people. Thus, frozen tea or frozen sports drink is considered ice.

While the ice mold 10 or 28 has been illustrated and described with a cylindrical shaft 12 or 32, it may be desirable to taper the shaft somewhat with the largest diameter portion adjacent the handle 14 or 34. This would make it easier to remove the ice mold after the frozen ring has been formed.

While the central passageways 16 and 40 have been illustrated as cylinders, it is clear that other cross sectional shapes may be used if desired. For example, the fluid may be poured through a square opening also.

While the cylindrical shafts 12 and 32 of the ice molds 10 and 28 have been shown as hollow cylinders, it is apparent that solid cylinders may be used if desired. If the shafts 12 or 32 are solid, then the amount of fluid poured into the bottle 30 should be measured to be sure it does not extend beyond the end of the shaft 12 or 32 when the bottle is inverted as shown in FIG. 4. Otherwise, the ice ring may have a solid end which prevents filling the bottle with the desired drink. It should be further appreciated that, if the ice molds 10 or 28 are formed with solid cylindrical shafts, then the drink cannot be added to the bottle 30 before the ice mold 10 or 28 is removed. Thus, use of the invention would be limited to that aspect where the ice mold 10 or 28 is removed before adding the drink. It is preferred, therefore, that the ice molds 10 or 28 are formed to include the hollow cylindrical shafts.

As illustrated in FIG. 4, a seal between the ice mold 28 and the bottle 30 is formed by O-rings 38 carried in grooves 36 on shaft 32. Other forms of seals may be used if desired. For example, instead of grooves 36, one or more flanges, e.g. in the shape of half of an O-ring, could be molded extending out from the shaft 32. Since the ice mold 28 is preferably cast from a plastic material, that material may be chosen to form a water-tight seal with the inner surface of the bottle neck 42. As shown in FIG. 2 a seal may be formed with one O-ring or flange instead of two as shown in FIG. 4.

While the present invention has been illustrated and described in terms of particular apparatus and methods of use, it is apparent that equivalent parts may be substituted of those shown and other changes can be made within the scope of the present invention as defined by the appended claims.

What is claimed is:

1. For a bottle having a main body portion which defines an interior volume of said bottle and a neck portion positioned above and integrally formed with said main body portion, said neck portion defining an access opening into said interior volume of said bottle, a device for forming ice within said bottle, comprising:

a shaft member having first and second ends, said shaft member sized such that a first portion thereof extends into said interior volume of said bottle and an exterior side surface of a second portion frictionally engages an interior side of said neck portion of said bottle when said shaft member is inserted through said access opening of said bottle; and a handle member attached to said first end of said shaft, said handle member remaining outside said access opening of said bottle when said shaft member is inserted therethrough;

wherein an ice ring is formable between an exterior side surface of said first portion of said shaft and said interior side surface of said main body portion.

2. An ice molding device according to claim 1, wherein:

said shaft and said handle have a fluid passageway adapted for flowing fluid between said handle and said second end of said shaft formed therein; and wherein said ice ring is further formable between said neck portion of said bottle and said second end of said shaft.

3. An ice molding device according to claim 1, and further comprising:

means for forming a fluid tight seal between said exterior side surface of said second portion of said shaft and said interior side surface of said neck.

4. An ice molding device according to claim 2, wherein said means for forming a fluid tight seal further comprises a seal engaged to said exterior side surface of said second portion of said shaft, said seal having an outer diameter sized to form said fluid tight seal with said interior side surface of said neck.

5. An ice molding device according to claim 4, and further comprising:

an annular recess formed on said exterior side surface of said second portion of said shaft; and wherein said seal further comprising an O-ring partially located within said annular recess.

* * * * *